US007971283B2

(12) United States Patent
Winterhalter et al.

(10) Patent No.: US 7,971,283 B2
(45) Date of Patent: Jul. 5, 2011

(54) DISPOSABLE NON-WOVEN, FLAME-RESISTANT COVERALLS

(75) Inventors: Carole Winterhalter, Marlborough, MA (US); Heather Cumming Rowell, Weymouth, MA (US); Henry Case, Framingham, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/632,172

(22) Filed: Dec. 7, 2009

(65) Prior Publication Data

US 2010/0146686 A1 Jun. 17, 2010

Related U.S. Application Data

(62) Division of application No. 11/638,040, filed on Dec. 12, 2006, now abandoned.

(51) Int. Cl.
*A41D 13/02* (2006.01)
*A41D 13/00* (2006.01)
*A41D 27/02* (2006.01)

(52) U.S. Cl. ..... 2/456; 2/458; 2/457; 2/227; 2/247

(58) Field of Classification Search ..... 2/455, 457, 2/458, 69, 69.5, 79, 81, 82, 227, 237, 247, 2/900, 902; 428/920, 921
See application file for complete search history.

(56) References Cited

U.S. PATENT DOCUMENTS 3,921,224 A * 11/1975 Ingram, III ..... 2/93
4,216,261 A * 8/1980 Dias ..... 442/84
4,433,493 A 2/1984 Poisson
4,463,465 A * 8/1984 Parker et al. ..... 5/653
4,513,042 A 4/1985 Lumb
4,605,586 A * 8/1986 Lane ..... 442/79
4,610,905 A * 9/1986 von Blucher et al. ..... 428/90
4,709,419 A * 12/1987 Heyn et al. ..... 2/46
4,748,996 A * 6/1988 Combier ..... 139/415
4,970,105 A 11/1990 Smith
4,988,746 A 1/1991 Tanaka
4,996,099 A 2/1991 Cooke
5,033,262 A 7/1991 Montgomery
5,150,476 A * 9/1992 Statham et al. ..... 2/93
5,323,815 A 6/1994 Barbeau
5,503,916 A 4/1996 Ichibori
5,652,966 A * 8/1997 Reinert, Sr. ..... 2/457
5,692,935 A * 12/1997 Smith ..... 442/38

(Continued)

*Primary Examiner* — Bobby H Muromoto, Jr.

(74) *Attorney, Agent, or Firm* — Vincent Ranucci; Roger C. Phillips

(57) ABSTRACT

A non-woven, flame resistant fabric and a disposable coverall made from the fabric. The non-woven, flame resistant fabric is made of a plurality of NOMEX® synthetic fibers, a plurality of KEVLAR® synthetic fibers, and a plurality of electrostatic dissipative fibers. The coverall has an upper section for covering the shoulder, chest, back and abdominal regions of a wearer. The upper section has long sleeves to cover the arms of the wearer and a collar to cover the neck region of wearer. The coverall also has a waist section contiguous with the upper section for covering the waist region of a wearer, and a pair of leg sections for covering the legs of the wearer. Each leg section has an upper portion contiguous with the waist section. The coverall also has a seat section contiguous with the waist section and the upper portions of the leg sections. The coverall has a two-way zipper extending from the collar section to the waist section.

9 Claims, 2 Drawing Sheets

U.S. PATENT DOCUMENTS 6,209,144 B1 * 4/2001 Carter ..... 2/458
6,341,384 B1 * 1/2002 Hayes ..... 2/458
6,625,816 B1 * 9/2003 Cooke ..... 2/161.5
6,727,197 B1 * 4/2004 Wilson et al. ..... 442/301
6,787,228 B2 9/2004 Campbell
6,800,367 B2 10/2004 Hanyon
6,805,957 B1 * 10/2004 Santos et al. ..... 428/400
6,840,288 B2 1/2005 Zhu
6,946,412 B2 * 9/2005 Campbell et al. ..... 442/302
6,955,193 B2 10/2005 Hainsworth
6,989,194 B2 1/2006 Bansal
6,990,687 B2 1/2006 Snedeker
7,010,811 B1 3/2006 Park
2003/0196246 A1 * 10/2003 Schweer ..... 2/94
2004/0203305 A1 * 10/2004 Horrocks et al. ..... 442/138
2004/0209051 A1 * 10/2004 Santos et al. ..... 428/195.1
2005/0130533 A1 * 6/2005 Lapierre ..... 442/197
2007/0148449 A1 * 6/2007 Winterhalter ..... 428/362
2008/0028496 A1 * 2/2008 Ma ..... 2/159

* cited by examiner

DISPOSABLE NON-WOVEN, FLAME-RESISTANT COVERALLS

RELATED APPLICATION

This is a Divisional Application of U.S. patent application Ser. No. 11/638,040 filed Dec. 12, 2006 now abandoned. This Divisional Application claims priority under 35 U.S.C. 120 to the filing date of U.S. patent application Ser. No. 11/638,040, the entire teachings of which are incorporated herein by reference.

STATEMENT OF GOVERNMENT INTEREST

The invention described herein may be manufactured and used by or for the Government of the United States of America for Governmental purposes without payment of any royalties thereon or therefore.

BACKGROUND OF THE INVENTION

1. Field of the Invention

The present invention is generally related to a non-woven, flame resistant fabric and coveralls made from such fabric.

2. Description of the Prior Art

Prior art combat uniform fabrics are woven from yarns made from a staple blend of cotton and nylon fiber. This fiber selection primarily supports dyeing and printing using a combination of acid and vat dyes to impart a camouflage pattern providing both visual and near infrared camouflage protection. This cotton and nylon fiber blend yarn, in combination with a lightweight, thin fabric construction, has consistently provided protection, comfort, durability, and UV resistance for U.S. military service personnel for more than twenty years. Many attempts were made to integrate flame and thermal protection into the aforementioned cotton and nylon fiber blend with little success. Such attempts to integrate flame and thermal protection into the this cotton and nylon fiber blend include fibers, fiber blends and functional finishes such as BASOFIL® flame resistant fiber, Flame Retardant Treated (FRT) cotton, FRT cotton/nylon, FRT TENCEL® fibers, FRT cotton/KEVLAR® para-aramid synthetic fiber/nylon, carbonized rayon/NOMEX® meta-aramid synthetic fiber, KEVLAR® para-aramid synthetic fiber/FR rayon, NOMEX® meta-aramid synthetic fiber/FR rayon, PBI® polybenzimidazole fiber and PBI® polybenzimidazole fiber/FRT cotton. However, many of the inherently flame resistant fibers were eliminated for use in a homogeneous fabric due to their high cost and the requirement for visual and near infrared camouflage. The high polymer orientation of the aramids and PBI, for example, contributes to their flame resistance, but also reduces or eliminates their ability to be dyed with traditional dyestuffs due to the lack of chemical dye sites. Some of these materials may achieve coloration by pigment injection in solution form, but their versatility is limited. Aramid blends are dyed and camouflage-printed using proprietary technology that significantly increases the final cost of the finished fabric. Still prized for their inherent flame resistance, some of these fibers were blended with low cost fibers to enhance the overall flame resistance of the fabric. Flame retardant rayon, which is inherently flame resistant rather than flame retardant treated, was blended with the aramids in 60/40 and 35/65 percent blend ratios, but these materials fell short of the desired fabric strength and the camouflage print demonstrated poor colorfastness.

Another prior art fiber is flame-retardant cotton. Flame-retardant treated cotton has long been the industry standard for use in low cost flame resistant industrial work wear. However, the most commonly used flame-retardant treated cotton, INDURA® flame retardant treated cotton fabrics, adds 20 percent to the weight of the fabric. Flame-retardant treated cotton was blended with nylon in 88/12 percent blend ratios, wherein the nylon was added to improve strength. While the addition of the nylon did not negatively impact the flame resistance, a heavier weight fabric of 11 ounces/yard was required to achieve relatively acceptable breaking and tearing strengths. Flame-retardant treated cotton was also blended with KEVLAR® para-aramid synthetic fiber consisting of poly-paraphenylene terephthalamide and nylon to enhance flame resistance and improve abrasion resistance in a 58/27/15 percent blend ratio. While the KEVLAR® synthetic fiber was the strongest of the three fibers, it occupied less than 50 percent of the total material composition to reduce costs and therefore, the strength of the fabric was determined by the lower strength cotton. In addition, the high end and pick count required to anchor the KEVLAR® synthetic fiber detrimentally reduced the fabric tearing strength to three pounds in the warp and filling directions. PBI® polybenzimidazole fiber was blended with flame-retardant treated cotton in 20/80 percent blend ratio in 5.0 and 6.6 ounce/yard$^2$ weights, however, the performance characteristics were reflective of the predominate fiber, which was, cotton.

BASOFIL® non-woven fabric fiber demonstrated low fiber tenacity and corresponding developmental efforts were directed toward insulation, knitted headwear and hand wear applications wherein high strength was not a critical factor. Blends of carbonized rayon and NOMEX® synthetic fiber consisting of aromatic polyamide polymer were also investigated and, while they demonstrated good strength performance, they could not be dyed and camouflage printed. Flame-retardant treated TENCEL® fibers demonstrated good strength but the camouflage print design demonstrated poor colorfastness performance.

Core spun yarns were also investigated and developed with the primary intent of manufacturing a yarn that has a high strength, inherently flame resistant core, and low cost readily camouflage printable sheath fiber. The best performing material combination was a cotton sheath, KEVLAR® synthetic fiber core yarn. However, these materials did not achieve the required strength because only the KEVLAR® synthetic fiber core and not the sheath contributed to the fabric strength.

While all of the developmental materials investigated met the fabric flame resistance goals (ASTM D 6413; 2.0 seconds, maximum after flame; 25.0 seconds, maximum after glow; 4.0 inches maximum char length), these materials did not achieve the required strength and other performance requirements such as colorfastness of the camouflage print design.

What is needed is a new and improved non-woven, flame resistant garment.

SUMMARY OF THE INVENTION

Accordingly, it is an object of the present invention to provide a non-woven, flame resistant garment.

It is another object of the present invention that the aforesaid non-woven, flame resistant garment be disposable.

It is a further object of the present invention that the aforesaid non-woven, flame resistant garment be configured as coveralls that can be worn over regular clothing.

It is yet another object of the present invention that the aforesaid non-woven, flame resistant garment can be manufactured at reasonable cost.

Other objects and advantages of the present invention will be apparent from the ensuing description and the accompanying drawings.

Thus, the present invention is directed to a non-woven, flame resistant fabric and disposable coveralls made from this fabric.

In a preferred embodiment, the non-woven, flame resistant fabric of the present invention is made from a plurality of NOMEX® synthetic fibers, a plurality of KEVLAR® synthetic fibers, and a plurality of electrostatic dissipative fibers.

The non-woven, flame-resistant coveralls of the present invention provide flame and thermal protection and can be manufactured at relatively low per-unit cost. The coveralls can be quickly deployed and significantly improve the survivability of the individual soldier. In a preferred embodiment, the coveralls have an upper section for covering the shoulder, chest, back and abdominal regions of a wearer. The upper section has long sleeves to cover the arms of the wearer and a collar to cover the neck region of wearer. Each long sleeve has a corresponding elbow section. The coverall also has a waist section for covering the waist region of a wearer, and a pair of leg sections for covering the legs of the wearer. Each leg section has an upper portion contiguous with the waist section. Each leg section also has a corresponding knee portion. The coveralls also have a seat section contiguous with the waist section and the upper portions of the leg sections. The coveralls have a two-way zipper extending from the collar section to the waist section. The coveralls include a flap that covers the zipper. In a preferred embodiment, the fabric forming the waist and seat sections has a degree of elasticity. In a preferred embodiment, the coveralls include at least one pocket that is formed with the fabric and is attached to the waist section. The coveralls include pass-through openings or slits under the pocket to provide access to undergarments. In a preferred embodiment, the coveralls include seat patches, knee patches and elbow patches all made from the fabric of the present invention. The seat patch is attached to and covers the seat section. Each knee patch covers a corresponding knee portion. Each elbow patch covers a corresponding elbow portion. In a preferred embodiment, each leg section has an ankle portion that has a degree of elasticity and each long sleeve has a wrist portion that has a degree of elasticity.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which.

DESCRIPTION OF THE PREFERRED EMBODIMENTS

Although the fabric and coveralls of the present invention are discussed in terms of military applications, it is to be understood that the aforesaid fabric and coveralls may be used in non-military applications such as firefighting, law enforcement, auto-racing, aviation, search and rescue, and hazardous materials clean-up.

Figure 1:
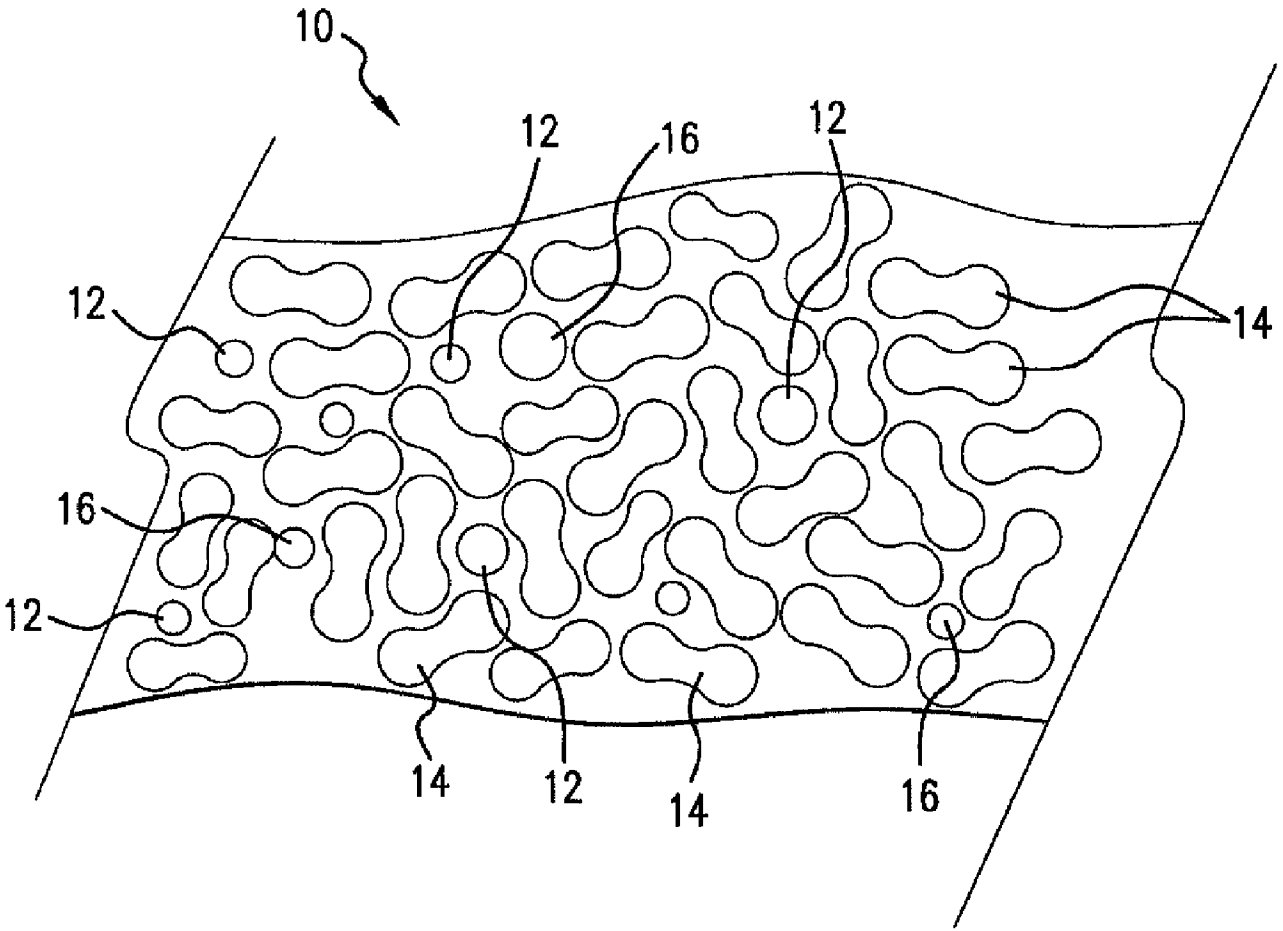
FIG. 1 is a partial, cross-sectional view of a non-woven, flame-resistant fabric in accordance with one embodiment of the present invention.

Referring to FIG. 1, there is shown fabric 10 in accordance with one embodiment of the present invention. Fabric 10 generally comprises a blend of aramid and electrostatic dissipative fibers. Specifically, fabric 10 comprises a blend of KEVLAR® synthetic fibers 12 NOMEX® synthetic fibers 14 and electrostatic dissipative fibers 16. In one embodiment, the percentages shown in Table I are used to form fabric 10:

TABLE I

| FIBER | PERCENTAGE |
|---|---|
| NOMEX ® meta-aramid synthetic fiber | 92.0 |
| KEVLAR ® para-aramid synthetic fiber | 5.0 |
| Electrostatic Dissipative | 3.0 |

It is to be understood that the percentages shown in Table I pertain to one embodiment and that these percentages may be varied.

Suitable electrostatic dissipative fibers are Nobel Fiber X-STATIC® synthetic fibers. The aforesaid X-STATIC® synthetic fiber is a fiber having a layer of silver that is coated over the surface thereof. Sauquoit Industries, of Scranton, Pa., manufactures X-STATIC® synthetic fibers and markets such fibers under the X-STATIC I® and X-STATIC II® synthetic fibers trademarks. Additional electrostatic fiber is INVISTA® fabric P-140, which has a carbon core and nylon sheath.

In a preferred embodiment, fabric 10 is made through a non-woven process called spun-lacing. It has been found that spun-lacing provides fabric 10 that is low cost, lightweight, and air permeable. However, it is to be understood that other non-woven techniques may be used to manufacture fabric 10 such as needle punching, thermal bonding, spun-bonding, etc. In one embodiment, fabric 10 is camouflage printed with a pigment printing technique. Alternatively, fabric 10 may be colored through the use of producer-colored fiber. Other suitable printing techniques may be used as well. In one embodiment, fabric 10 may be subsequently treated with a water repellant treatment, an oil repellant treatment and/or an insect resistant treatment. In another embodiment an electrostatic dissipative surface treatment or humectant may be used in addition to an electrostatic dissipative fiber or in place of one. Such treatments are known in the art. Thus, fabric 10 is relatively light in weight and is manufactured by a relatively low-cost, non-woven process.

Figures 2, 3:
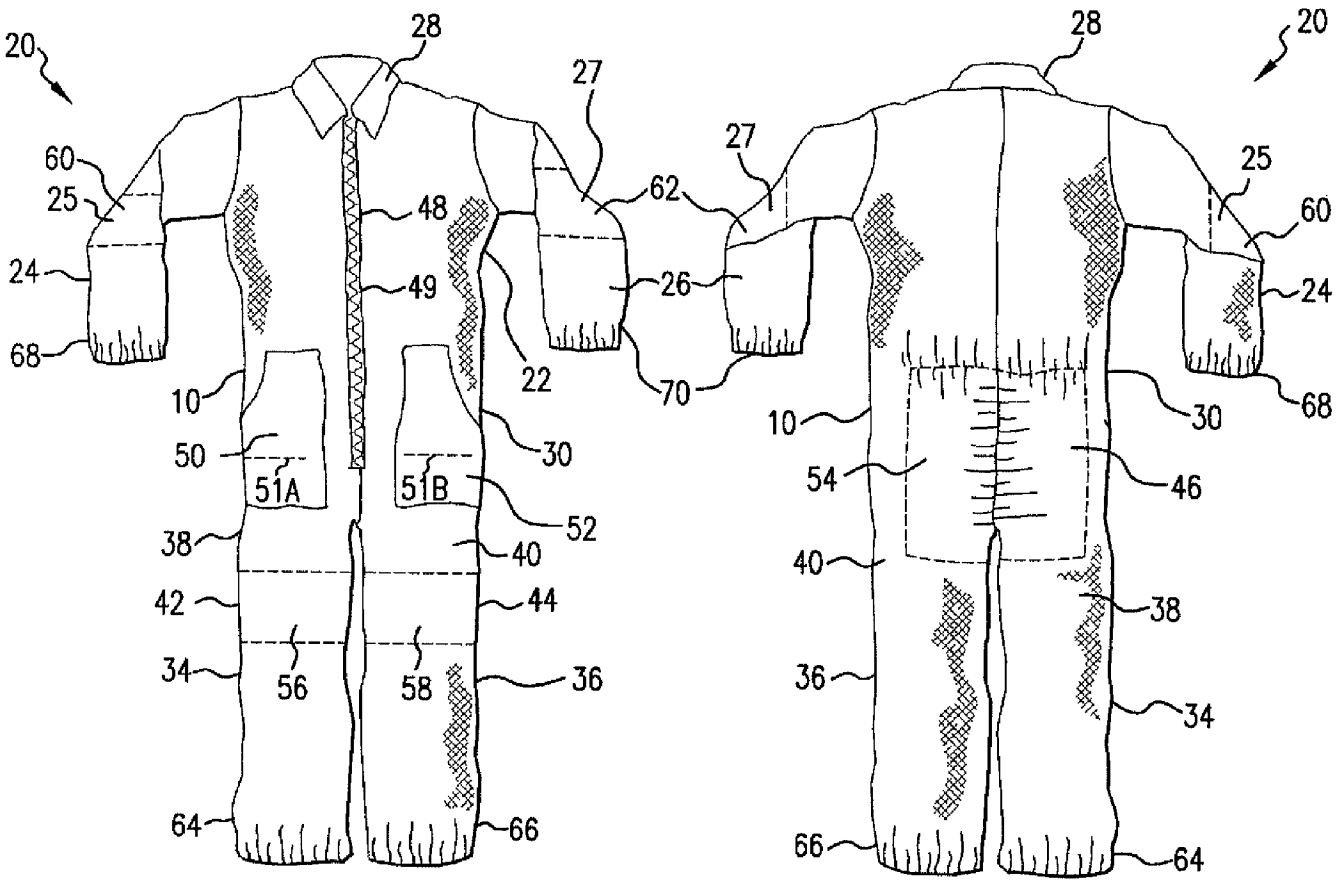
FIG. 2 is a front elevational view of coveralls made from the fabric of FIG. 1.
FIG. 3 is a rear elevational view of the coveralls of FIG. 2.

Referring to FIGS. 2 and 3, there is shown coveralls 20 that are made from fabric 10 in accordance with the invention. Thus, coverall 20 has multi-functional characteristics including flame protection, camouflage, and electrostatic dissipation. Coverall 20 has upper section 22 for covering the shoulder, chest, back and abdominal regions of a wearer. Upper section 22 has long sleeve 24, which has elbow portion 25, and long sleeve 26, which has elbow portion 27, to cover the arms of the wearer. Coverall 20 includes collar 28 to cover the neck region of wearer. Coverall 20 has waist section 30 that is contiguous with upper section 22 for covering the waist region of a wearer, and a pair of leg sections 34 and 36 for covering the legs of the wearer. Each leg section 34 and 36 has upper portions 38 and 40, respectively, which are contiguous with waist section 30. Leg sections 34 and 36 have knee portions 42 and 44, respectively. Coverall 20 also has seat section 46 contiguous with waist section 30 and upper portions 38 and 40 of leg sections 34 and 36, respectively. Coverall 20 has two-way zipper 48 (shown in phantom) extending from collar section 28 to waist section 30. In a preferred embodiment, two-way zipper 48 is a two-way black-oxidized brass zipper. In an alternate embodiment, two-way zipper 48 is a plastic zipper. Coveralls 20 include flap 49 that covers two-way zipper 48. Flap 49 is made from fabric 10. In a preferred embodiment, waist section 30 and seat section 46 have a degree of elasticity. In a preferred embodiment, coveralls 20 includes pockets 50 and 52 that are attached to waist section 30. Pockets 50 and 52 are formed with fabric 10. Coveralls 20 include slits, or openings, 51A and 51B (shown in phantom) that are underneath pockets 50 and 52, respectively. Slits 51A and 51B allow the user access to the undergarments that are worn under coveralls 20. In one embodiment, coverall 20 includes seat patch 54 that is attached to and covers seat section 46 (see FIG. 3). Seat patch 54 is made from fabric 10. Coverall 20 includes knee patches 56 and 58 that are attached to and cover knee portions 42 and 44, respectively. Knee portions 42 and 44 are made from fabric 10. Coverall 20 includes elbow patches 60 and 62 that are attached to and cover elbow portions 25 and 27, respectively. Elbow patches 60 and 62 are made from fabric 10. Leg sections 34 and 36 have ankle portions 64 and 66, respectively, which preferably have a degree of elasticity. Long sleeves 24 and 26 have wrist portions 68 and 70, respectively, which preferably have a degree of elasticity.

The design and construction of coverall 20 is relatively less complex than many prior art flame-resistant garments. Coveralls 20 can be configured to have any one of plurality of sizes to accommodate wearers of different sizes. Coveralls 20 can be configured to have more than two pockets or just one pocket.

The present invention provides many advantages. Since fabric 10 is light in weight, has a relatively simple construction, made with a low-cost non-woven method, and printed with a low-cost camouflage printing technique, coverall 20 is intended to be disposable. Testing has shown that coverall 20 can be worn and laundered approximately 10 times. Due to the coverall's light weight and air-permeable construction, coverall 20 can be worn over the other clothing such as an ACU (Army Combat Uniform). Thus, coverall 10 may be carried with the soldier and donned over existing clothing to provide quick, low cost, flame and thermal protection. The flame resistant NOMEX® synthetic fiber and KEVLAR® synthetic fiber blend of fabric 10 provides ignition resistance. Furthermore, the thickness of coverall 20 and the wearer's underclothes provides thermal protection through insulation. Instrumented manikin testing has demonstrated that coverall 20 reduces overall body burn from about 88.0% to 8.0% when coverall 20 is worn over the Hot Weather BDU (Battledress Uniform). Additional testing of coverall 20 established safe exposure limits up to 5 seconds.

Thus, the use of non-woven, flame-resistant coveralls 20 over inner, flammable clothing provides a clothing system having flame and thermal protection. Coveralls 20 can be colored in any desirable color and can be configured with a military camouflage pattern using any one of known suitable techniques. The elasticized seat and waist sections and elasticized wrist and ankle portions provides a close fit and maximum flame protection. The reinforcement elbow, seat and knee patches provide additional protection for the corresponding elbow, buttocks and knees, respectively, of a wearer.

Coveralls 20 of the present invention provide a significant advantage in the military scenario. Specifically, coverall 20 can be donned over any combat uniform when a flame and thermal threat or hazard is anticipated. In hot environments, coveralls 20 can be worn over long underwear rather than a combat uniform. Once the threat is diminished or removed, coverall 20 can be removed. Depending on the inner clothing over which coveralls 20 are worn, coveralls 20 provide a cost savings of anywhere from 48%-88% when compared to the cost of the currently available Aircrew Battledress Uniform. Coveralls 20 may be treated with water, oil and insect repellant treatments. Specifically, water, oil and insect repellants can be applied as functional finishes to the fabric. Other suitable treatments include fluro-chemical based water/oil finishes, and permethrin insect repellants.

The foregoing description of the preferred embodiments of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A disposable, non-woven, spin-laced, air permeable and flame resistant coverall for providing flame and thermal protection to a wearer, and providing for electrostatic dissipation, the coverall consisting of a homogeneous, air permeable fabric, said fabric comprising:

a plurality of meta-aramid fibers consisting of aromatic polyamide polymer;

a plurality of para-aramid fibers consisting of poly-para-phenylene terephthalamide; and a plurality of electrostatic dissipative fibers;

said fabric being provided with at least one of water repellent, oil repellent and insect repellent;

wherein at least a plurality of said fibers are provided with predetermined color; and wherein said fabric is provided with a camouflaged pattern printed thereon;

the coverall is adapted for being worn over other clothing; and the coverall is provided with an upper section for covering shoulder, chest, back, and abdominal regions of a wearer, the upper section including:

long sleeves to cover the arms of the wearer, wherein each of the long sleeves is provided with an elbow portion, and wherein each of the long sleeves is provided with a wrist portion that exhibits elasticity;

the coverall further consisting of a pair of elbow patches formed from said fabric, each of said elbow patches covering an elbow portion of a long sleeve;

a collar to cover a neck region of the wearer;

a waist section contiguous with the upper section for covering a waist region of the wearer, said waist section being elastic;

a two way zipper extending from said collar to said waist section; and at least one pocket formed from said fabric, said pocket being attached to said waist section;

the coverall is further provided with a pair of leg sections for covering legs of the wearer, each leg section having a knee portion, and each leg section having an upper portion contiguous with said waist section, and a seat section contiguous with said waist section and upper portions of the leg sections, said seat section exhibiting elasticity;

a seat patch formed from said fabric, said seat patch covering substantially the entirety of said seat section;

wherein each of the leg sections is provided with a knee section; and the coverall further comprises a pair of knee patches formed from said fabric, each of said knee patches covering a knee section of a leg section, and wherein each leg section is provided with an ankle portion that exhibits elasticity;

wherein the coverall is adapted to provide up to five seconds of full body thermal protection; and wherein the coverall is adapted to be worn over a hot weather military Battle Dress Uniform and to reduce overall body burn from 88.0% to 8.0%.

2. The non-woven flame resistant coverall according to claim 1 wherein said fabric comprises about 92% meta-aramid fibers, about 5% para-aramid fibers, and about 3% electrostatic dissipative fibers.

3. The coverall according to claim 1 and further consisting of a flap for covering said zipper.

4. The coverall according to claim 1 and further consisting of a pass-through opening under said pocket for providing access to an undergarment.

5. The coverall fabric in accordance with claim 1 wherein said meta-aramid fibers comprise meta aramid material and said para-aramid fibers comprise para aramid material.

6. The coverall fabric in accordance with claim 5 wherein said fibers comprise about 92% meta aramid material, about 5% para aramid material, and about 3% electrostatic dissipative fibers.

7. The coverall fabric in accordance with claim 6 wherein the electrostatic dissipative fibers comprise electrostatic dissipative synthetic fibers.

8. The coverall fabric in accordance with claim 7 wherein each of said synthetic electrostatic dissipative fibers is provided with a layer of silver coated over a surface thereof.

9. The coverall fabric in accordance with claim 6 wherein said electrostatic dissipative fibers comprise fibers which are provided with a carbon core and a nylon sheath.

* * * * *